US005779821A

United States Patent [19]

Ishii et al.

[11] Patent Number: 5,779,821

[45] Date of Patent: Jul. 14, 1998

[54] ROTOR FOR STEAM TURBINE AND MANUFACTURING METHOD THEREOF

[75] Inventors: Ryuichi Ishii, Kanagawa-ken; Yoichi Tsuda, Tokyo; Masayuki Yamada, Kanagawa-ken, all of Japan

[73] Assignee: Kabushiki Kaisha Toshiba, Kanagawa-ken, Japan

[21] Appl. No.: 276,920

[22] Filed: Jul. 19, 1994

[30] Foreign Application Priority Data

Jul. 23, 1993 [JP] Japan ..... 5-182647

[51] Int. Cl.[6] ..... C21D 8/10; C22C 38/46; C22C 38/44

[52] U.S. Cl. ..... 148/326; 148/325; 148/547; 148/654

[58] Field of Search ..... 420/38, 69; 148/326, 148/654, 547

[56] References Cited

U.S. PATENT DOCUMENTS

| | | |
|---|---|---|
| 4,564,392 | 1/1986 | Ohhashi et al. . |
| 4,857,120 | 8/1989 | Watanabe et al. . |

FOREIGN PATENT DOCUMENTS

| | | | |
|---|---|---|---|
| 0073021 A1 | 3/1981 | European Pat. Off. . | |
| 0210122 A1 | 1/1987 | European Pat. Off. . | |
| 3426882 A1 | 4/1985 | Germany . | |
| 3522115 A1 | 1/1986 | Germany . | |
| 47-47488 | 11/1972 | Japan . | |
| 59-133354 | 7/1984 | Japan | 420/40 |
| 59-179718 | 10/1984 | Japan . | |
| 60-54385 | 11/1985 | Japan . | |
| 61-133365 | 6/1986 | Japan . | |
| 62-103345 | 5/1987 | Japan . | |
| 4-147948 | 5/1992 | Japan . | |

OTHER PUBLICATIONS

Toshio Fujita, vol. 76, pp. 1053–1059 "Development of High Chromium Ferritic Steels For Ultra Super Critical Power Plant".

PWR, vol. 21, "The Steam Turbine Generator Today" Materials, Flow Path Design, Repair and Refurbishment, C. Berger, S.M. Beech, K.H. Mayer, M. Staubli, D.V. Thornton.

*Primary Examiner*—Deborah Yee

*Attorney, Agent, or Firm*—Finnegan, Henderson, Farabow, Garrett & Dunner, L.L.P.

[57] ABSTRACT

A rotor for steam turbine rotor made of a heat resistant steel having a composition, which contains 0.05 to 0.3% by weight of C, 8.0 to 13.0% by weight of Cr, 1.0% by weight or less (excluding 0%) of Si, 1.0% by weight or less (excluding 0%) of Mn, 2.0% by weight or less (excluding 0%) of Ni, 0.10 to 0.50% by weight of V, 0.50 to 5.0% by weight of W, 0.025 to 0.10% by weight of N, 1.5% by weight or less excluding 0%) of Mo, at least one element selected from the group consisting of 0.03 to 0.25% by weight of Nb and 0.03 to 0.50% by weight of Ta, 0 to 3% of Re, 0 to 5.0% by weight of Co, 0 to 0.05% by weight of B and the balance of Fe and inevitable impurities, and having a ferrite/martensite structure.

12 Claims, 2 Drawing Sheets

ROTOR FOR STEAM TURBINE AND MANUFACTURING METHOD THEREOF

BACKGROUND OF THE INVENTION

The present invention relates to a rotor for steam turbine to be used in power generation facilities.

Conventionally, it has been necessary that members to be used at high temperatures and under high pressures in thermal power generation facilities are those whose material characteristics are excellent as the whole, insusceptible to too much changes of these material characteristics even after they are exposed to high temperatures for many hours. As these members intended for use at high temperatures and under high pressures, heat resistant high-Cr ferrite based steels containing 8 to 12% of Cr have been used, so far. Steels of this kind are available at comparatively inexpensive prices, can easily be manufactured and have high values of physical properties. Thus, they have found their application in wide industrial segments, doing much to the improvement of the performance and reliability of facilities operating at high temperatures and under high pressures.

Conventionally, it has been the most important object to make compatible the high-temperature strength and the toughness which are incompatible each other, when high-Cr ferrite based steels are in development stages. One of the causes for the decline of toughness is that precipitates are deposited in crystal grain boundaries. Accordingly, whereas it has been attempted to prevent this precipitation, fine precipitates have been caused to separate out uniformly in the inside of crystal grains from solid solutions having a high concentration of parent phase, to obtain the high-temperature strength.

Conventional heat resistant high-Cr ferrite based steels have a problem, however. When the high-Cr ferrite based steels undergo creeps under stress at temperatures almost as high as 600° C. for a long term, their metal structure is markedly changed. A greater part of inevitable precipitates concentrates upon the crystal grain boundaries or martensite lath boundaries, while the density of precipitates is lowered in the inside of the martensite lath, together with the recovering of structure and the growth of subgrains. Thus, material characteristics of the steels such as impact resistance are lowered by far, in response to the changes of the structure described as above. Therefore, reliability of a thermal power plant may be poor if it comprises a large size member, a rotor for steam turbine made of conventional heat resistant high-Cr ferrite based steels and is operated in an atmosphere of steam at 600° C. or higher. On the other hand, there have been demands for the improvement of thermal efficiency of thermal power plants from the viewpoint of preserving global environment, and it is apparent that thermal power plants of high temperature and high pressure type, capable of using steam at 600° C. or higher, are necessary.

SUMMARY OF THE INVENTION

The present invention has been accomplished in an attempt to find a solution in these problems. Accordingly, an object of the present invention is to provide a rotor for steam turbine best suited as a member in a steam turbine to be operated at high temperatures, having an excellent high-temperature strength and capable of keeping that high-temperature strength unchanged for a long term.

The rotor for steam turbine of the present invention is made of a heat resistant steel having a composition, which contains in terms of percentage by weight 0.05 to 0.30% of C, 8.0 to 13.0% of Cr, 1.0% or less (excluding 0%) of Si, 1.0% or less (excluding 0%) of Mn, 2.0% or less (excluding 0%) of Ni, 0.10 to 0.50% of V, 0.50 to 5.0% of W, 0.025 to 0.10% of N, 1.5% or less (excluding 0%) of Mo, 0.03 to 0.50% of Ta and/or 0.03 to 0.25% of Nb, 0 to 5% of Re, 0 to 5.0% of Co, 0 to 0.05% of B and the balance of Fe and inevitable impurities, and having a martensite structure.

More particularly, the first version of the rotor for steam turbine of the present invention is made of a heat resistant steel having a composition, which contains in terms of percentage by weight 0.05 to 0.30% of C, 8.0 to 13.0% of Cr, 1.0% or less (excluding 0%) of Si, 1.0% or less (excluding 0%) of Mn, 2.0% or less (excluding 0%) of Ni, 0.10 to 0.50% of V, 0.03 to 0.50% of Ta, 0.50 to 5.0% of W, 0.025 to 0.10% of N, 1.5% or less (excluding 0%) of Mo and the balance of Fe and inevitable impurities, and having a martensite structure.

The second version of the rotor for steam turbine of the present invention is made of a heat resistant steel having a composition, which contains in terms of percentage by weight 0.05 to 0.30% of C, 8.0 to 13.0% of Cr, 1.0% or less (excluding 0%) of Si, 1.0% or less (excluding 0%) of Mn, 2.0% or less (excluding 0%) of Ni, 0.10 to 0.50% of V, 0.03 to 0.50% of Ta, 0.50 to 5.0% of W, 0.025 to 0.10% of N, 1.5% or less (excluding 0%) of Mo, 3.0% or less (excluding 0%) of Re and the balance of Fe and inevitable impurities, and having a martensite structure.

The third version of the rotor for steam turbine of the present invention is made of a heat resistant steel having a composition, which contains in terms of percentage by weight 0.05 to 0.30% of C, 8.0 to 13.0% of Cr, 1.0% or less (excluding 0%) of Si, 1.0% or less (excluding 0%) of Mn, 2.0% or less (excluding 0%) of Ni, 0.10 to 0.50% of V, 0.03 to 0.25% of Nb, 0.50 to 5.0% of W, 0.025 to 0.10% of N, 1.5% or less (excluding 0%) of Mo, 3.0% or less (excluding 0%) of Re and the balance of Fe and inevitable impurities, and having a martensite structure.

The fourth version of the rotor for steam turbine of the present invention is made of a heat resistant steel having a composition, which contains in terms of percentage by weight 0.05 to 0.30% of C, 8.0 to 13.0% of Cr, 1.0% or less (excluding 0%) of Si, 1.0% or less (excluding 0%) of Mn, 2.0% or less (excluding 0%) of Ni, 0.10 to 0.50% of V, 0.03 to 0.50% of Ta, 0.03 to 0.25% of Nb, 0.50 to 5.0% of W, 0.025 to 0.10% of N, 1.5% or less (excluding 0%) of Mo and the balance of Fe and inevitable impurities, and having a martensite structure.

The fifth version of the rotor for steam turbine of the present invention is made of a heat resistant steel having a composition, which contains in terms of percentage by weight 0.05 to 0.30% of C, 8.0 to 13.0% of Cr, 1.0% or less (excluding 0%) of Si, 1.0% or less (excluding 0%) of Mn, 2.0% or less (excluding 0%) of Ni, 0.10 to 0.50% of V, 0.03 to 0.50% of Ta, 0.03 to 0.25% of Nb, 0.50 to 5.0% of W, 0.025 to 0.10% of N, 1.5% or less (excluding 0%) of Mo, 3.0% or less (excluding 0%) of Re and the balance of Fe and inevitable impurities, and having a martensite structure.

The rotors of the first to fifth versions of the present invention are characterized in that the heat resistant steels futher contain 0.001 to 5.0% by weight of Co and/or 0.0005 to 0.05% by weight of B.

The rotors for steam turbine of the present invention are characterized in that they are respectively made of the heat resistance steels having a martensite structure wherein crystal grain diameters are uniformly distributed as the result of the heat treatment of said heat resistant steels at a quenching temperature of 1050° to 11500° C. Furthermore, they are characterized in that said heat treatment at the quenching temperature of 1050° to 1150° C. is followed by treatments at a temperature of 620° to 760° C. an additional heat.

The rotors for steam turbine of the present invention are characterized in that they are made of the heat resistant steels wherein precipitates are deposited in an total amount of 2.5 to 7.0% by weight in the crystal grain boundaries and martensite lath boundaries and in the inside of martensite lath because of said heat treatments.

Furthermore, they are characterized in that austenite crystals have a grain diameter of 50 to 100 μm after the heat treatment at the quenching temperatures.

The rotors for steam turbine of the present invention are characterized in that they are made from heat resistant steel ingots to be obtained by an electroslag remelting method. The rotors for steam turbine of the present invention comprise the high-Cr ferrite steels having a specific composition and previously containing a predetermined amount of the precipitates in the inside of martensite lath as well as those in the crystal grain boundaries or martensite lath boundaries conventionally regarded as start points for the decline of properties. In this way, the precipitates are used profitably to provide a heat resistant steel having a uniform metal structure with the advantages that the high-temperature creep rupture strength and creep resistance are improved and that the structure can remain stable after it is exposed to high temperatures for a long term. The rotors for steam turbine of the present invention have been completed on the basis of this finding.

FIG. 2 is a microscopic photograph showing an example of the metal structure of the heat resistant steel of the invention. As seen in FIG. 2, the heat resistant steel is composed of martensite crystal grains having a diameter of 50 to 100 μm.

Furthermore, they have been completed on the basis of another finding that these precipitates can easily be deposited due to the specific heat treatments.

Next, the reasons for limiting the range of compositions will be described below, with respect to the heat resistant steels to form the rotors for steam turbine of the present invention. As used in the descriptions below, the word "%" means "% by weight" unless otherwise stated expressly.

C is combined with the Cr, Nb and V, etc., to form carbides. The so formed carbides are deposited in the crystal grain boundaries and martensite lath boundaries or in the inside of martensite lath, contributing to the promotion of precipitation hardenning. C also is an element indispensable to improve quenching characteristics and inhibit the formation of δ ferrite. It is necessary to incorporate 0.05% or more of C, to obtain the desired creep rupture strength. If more than 0.30% of C is incorporated, however, the grains of carbides grow larger quickly, and it has been decided that the the heat resistant steels of the present invention should have a C content of 0.05 to 0.30%. The C content of 0.08 to 0.20% is more preferable.

Cr is an element indispensable to form $M_{23}C_6$ type precipitates, which contribute to solid solution hardening, precipitation-dispersion strengthening and grain boundary precipitation hardening simultaneously with the improvements of oxidation resistance and corrosion resistance. These effects cannot be obtained if less than 8% of Cr is incorporated. If more than 13% of this element is incorporated, δ ferrites are formed and the heat resistance steels may not be quenched or normalized from the austenite region, depending upon the balance between Cr and the remaining components. Thus, it has been decided that the heat resistant steels of the present invention should have a Cr content of 8.0 to 13.0%. The Cr content of 8.5 to 11.5% is more preferable.

V contributes to the solid solution hardening and the formation of fine vanadium carbide and/or nitride grains. In heat resistance steels wherein more than approximately 0.30% of V is incorporated, the fine grains of these precipitates are deposited, chiefly on the martensite lath boundaries during creeping, to inhibit the recovering and improve creep resistance. On the other hand, if more than 0.5% of this element is incorporated, the deposition of δ ferrite is markedly increased, and if less than 0.10% of V is incorporated, both solid solutions and precipitates are provided in too small amounts to obtain the desired effects as described above. Thus, it has been decided that the the heat resistant steels of the present invention should have a V content of 0.10 to 0.50%. The V content of 0.15 to 0.35% is more preferable.

W contributes to the solid solution hardening and the formation of intermetallic compounds essentially consisting of Fe, Cr and W, which are the most important in the heat resistant steels of the present invention. It is necessary to incorporate more than 0.5% of W, to deposit a greater part of intermetallic compounds in the crystal grain boundaries and martensite lath boundaries by means of appropriate heat treatments. If more than 5.0% of this element is incorporated, the toughness and heat-embrittlement thereof are reduced markedly and it has been decided that the heat resistant steels of the present invention should have a W content of 0.50 to 5.0%. The W content of 1.0 to 3.0% is more preferable.

Ta is an element useful for solid solution hardening and is combined with the C and N to form the fine grains of Ta carbide and/or nitride Ta (C, N) for contributing to the precipitation-dispersion strengthening. The deposition of fine Ta (C, N) grains is very effective in improving the creep rupture strength under high stress for a short term, but if less than 0.03% of the Ta is incorporated, the density of precipitates are too poor to obtain the effects described as above. On the other hand, if more than 0.50% of Ta is incorporated, the volume fraction rises quickly relative to coarse Ta (C, N) grains not contained in solid solutions and the aggregation of fine Ta (C, N) grains wherein they are changed into coarse grains is accelerated. Thus, it has been decided that the heat resistant steels of the present invention should have a Ta content of 0.03 to 0.50%. The Ta content of 0.04 to 0.30% is more preferable.

Re is effective in a trace amount in providing solid solution hardening and improving the toughness of heat resistance steels. If this element is incorporated in excessive amounts, the heat resistant steels of the present invention have poor processability and their economical efficiency is markedly spoiled, and it has been decided that the heat resistant steels of the present invention should have a Re content of 3% or less. The Re content of 2.0% or less is more preferable.

N contributes to the precipitation hardening by forming nitrides or carbide-nitrides. Furthermore, N left in the parent phase can contribute to the solid solution hardening. However, if less than 0.025% of the N is incorporated, these effects are not exhibited practically, and if more than 0.10% of the N is incorporated the nitrides or carbide-nitride are changed into coarse grains predominantly, with the result that creep resistance and manufacturing performance are lowered, and it has been decided that the heat resistant steels of the present invention should have a N content of 0.025 to 0.10%. The N content of 0.03 to 0.07% is more preferable.

Nb is combined with the C and N, to form the fine grains of Nb (C, N) carbide-nitride, contributing to the precipitation hardening. The Nb (C, N) is very effective in improving the creep rupture strength under high stress for a short term. However, if less than 0.03% of the Nb is incorporated, the density of precipitates is too low to obtain the effects described as above, and if more than 0.25% of Nb is incorporated, the volume fraction rises quickly relative to coarse Nb(C, N) grains not contained in solid solutions, while the aggregation of fine Nb(C, N) grains wherein they are changed into coarse grains is accelerated. Thus, it has been decided that the heat resistant steels of the present invention should have a Nb content of 0.03 to 0.25%. The Nb content of 0.05 to 0.20% is more preferable.

Si is an indispensable element as a deoxidizing agent, and if Si is incorporated in an amount up to approximately 1 %, creep resistance is improved slightly. If the Si is incorporated in excessive amounts, creep resistance is lowered, and further Si can be dispensed with if the heat resistant steels are deoxidized in the presence of carbon under vacuum (hereinafter referred to as "vacuum carbon deoxidation method"). Thus, it has been decided that the heat resistant steels of the present invention should have a Si content of 1.0% or less. The Si content of 0.3% or less is more preferable.

Mn is an important element as a desulfurizing agent and a deoxidizing agent, helpful in improving the toughness of heat resistant steels. However, if Mn is incorporated too much, creep resistance is lowered, and thus it has been decided that the heat resistant steels of the present invention should have a Mn content of 1.0% or less. The Mn content of 0.7% or less is more preferable.

Ni is helpful in improving quenching properties and the toughness of heat resistant steels and inhibiting the deposition of δ ferrites. However, if more than 2% of Ni is incorporated, creep resistance is markedly lowered, and thus it has been decided that the heat resistant steels of the present invention should have a Ni content of 2.0% or less. The Ni content of 0.8% or less is more preferable.

Mo is useful as an element to contribute to the solid solution hardening and to form carbides and is incorporated into the heat resistant steels. However, if Mo is incorporated too much, δ ferrites are formed to lower the toughness markedly and to give rise to the deposition of intermetallic compounds chiefly comprising Fe, Cr and Mo and having low stability against the exposure to high temperatures for a long term. Thus, it has been decided that the heat resistant steels of the present invention should have a Mo content of 1.5% or less. The Mo content of 1.0% or less is more preferable.

Co is helpful in providing solid solution hardening, useful in inhibiting the deposition of δ ferrite and should be incorporated in the heat resistant steels of the present invention. If less than 0.001% of the Co is incorporated, these effects cannot practically be obtained. If more than 5% of Co is incorporated, creep resistance is lowered and economical efficiency of these heat resistant steels is spoiled. Thus, it has been decided that the heat resistant steels of the present invention should have a Co content of 0.001 to 5.0%.

B is helpful in a trace amount in promoting the deposition of precipitates in the crystal grain boundaries and enabling the carbide and/or nitride to remain stable after they are exposed to high temperatures for a long term. This element is markedly effective for the precipitates of $M_{23}C_6$ type which are liable to deposit in the crystal grain boundaries and their neighborhood. If less than 0.0005% of B is incorporated, these effects are poor. If more than 0.05% of B is incorporated, processability is spoiled and creep resistance is lowered in the heat resistant steels. Thus, it has been decided that the heat resistant steels of the present invention should have a B content of 0.0005 to 0.05%.

It is desirable to eliminate to the greatest possible extent impurities which are inevitably contained in the heat resistant steels of the present invention as incidental to these components and Fe, the chief component, when they are in incorporated. As used herein, the words inevitable impurities mean elements such as P, S, Sb, As, Sn and the like.

Next, a quenching heat treatment temperature will be described below.

Ta and Nb (at least one element selected from the group consisting of Ta and Nb) are selectively incorporated into the heat resistant steels of the present invention. These elements form precipitates with C and N, wherein if the steels are quenched at temperatures lower than 1050° C., coarse grains of carbide and/or nitride deposited upon the solidification of steels continue in existence even after the heat treatments, inhibiting the creep rupture strength from increasing to perfection. In order to solid-solute these coarse grains of carbide and/or nitride and precipitate in high density as fine grains, it is necessary to quench them from an austenitizing temperature of 1050° C. or higher where austenitizing is advanced. On the other hand, temperatures of higher than 1150° C. are within a temperature region for the heat resistant steels of the present invention to deposit δ ferrites. Thus, coarse crystal grains having greater diameters are predominantly produced, with the result that the toughness of steels is lowered. Thus, the quenching temperatures in a range of 1050° to 1150° C. are preferable.

Next, a tempering temperature will be described below.

The heat resistant steels of the present invention are characterized in that they are subjected to the heat treatment at tempering temperatures in a range of 620° to 760° C. When they are treated at the tempering temperatures, the intermetallic compounds of comprising Fe, Cr and W and the precipitates chiefly comprising Cr and C are deposited in the crystal grain boundaries and in the martensite lath boundaries, while the precipitates chiefly comprising Ta, C and N and/or those chiefly comprising Nb, C and N are deposited in the inside of martensite lath. If the tempering temperatures are lower than 620° C., the intermetallic compounds chiefly comprising Fe, Cr and W are deposited in the inside of martensite lath in a great amount. Accordingly, the crystal grain boundaries and martensite lath boundaries have a relatively low volumetric fraction of the precipitates which are expected to uphold the creep rupture strength against the exposure to high temperatures for a long term. On the other hand, if the tempering temperatures are higher than 760° C., the precipitates chiefly comprising Ta, C and N and/or those chiefly comprising Nb, C and N are deposited in low density in the inside of martensite lath, and tempering become in excess. Furthermore, these temperatures are very close to a transformation point wherein austenite crystals start forming. Thus, the tempering temperatures in a range of 620° to 760° C. are preferable. Furthermore, it is acceptable to provide another tempering heat treatment prior to the tempering heat treatment at 620° to 670° C. if necessary.

The heat treatments described as above are provided to regulate that the precipitates are deposited in a total amount of 2.5 to 7.0% by weight in the crystal grain boundaries and martensite lath boundaries and in the inside of martensite lath, to improve the high-temperature creep rupture strength and creep resistance and minimize the decline of properties after the heat resistant steels are exposed to high temperatures for a long term. The precipitates in a total amount of 3.0 to 6.0% by weight are more preferable.

The total amount of precipitates is determined in this way. A test sample is placed in a mixed liquid of hydrochloric acid and perchloric acid, and its parent phase is dissolved by the ultrasonic dissolution method and filtered. The resultant residue is washed and determined and the results of determination are expressed in terms of % by weight.

Next, a crystal grain diameter of the heat resistant steels of the present invention will be described below.

Conventionally, coarse crystal grains having a great diameter have been inhibited in high-Cr ferrite based steels, in order to keep the toughness high and improve the fatigue strength. In the heat resistant steels of the present invention wherein grain boundary-precipitation hardening is used profitably, their creep resistance can be improved to a great extent by adjusting crystal grain diameters to 50 to 100 μm. The crystal grains having diameters adjusted to such a greater size can reduce the area of crystal grain diameters wherein the deformation occurs preferentially at high temperatures. In this way, the precipitates having a specific volume fraction for a material can be deposited in high density in the grain boundaries, to inhibit the deformation efficiently in the neighborhood of the grain boundaries, as compared with the same material with the crystal grains adjusted to small diameters. If the crystal grains have a diameter of less than 50 μm, the heat resistant steels have low values of the creep rupture strength, and if more than 100 μm their toughness is lowered to a great extent. Thus, the crystal grain diameters are preferably in a range of 50 to 100 μm.

Next, a method for melting will be described below, with respect to the heat resistant steels of the present invention.

Heat resistant steel ingots of the present invention are characterized in that they are manufactured by the use of an electroslag remelting method. Large size parts such as rotor for steam turbine are susceptible to the segregation of incorporated elements or the unevenness of solidified structures upon the solidification of melts. The heat resistant steel ingots of the present invention may as well be manufactured by ordinary manufacturing methods including the vacuum carbon deoxidizing method. These ordinary methods have a defect that, when these large size parts are founded, they are strongly inclined to have a segregation of elements in their center portion as these elements are incorporated one after another for the purpose of obtaining higher strengths. Thus it is preferable to use the electroslag remelting method to provide the heat resistant steels of the present invention.

DESCRIPTION OF THE PREFERRED EMBODIMENTS

Figure 1:
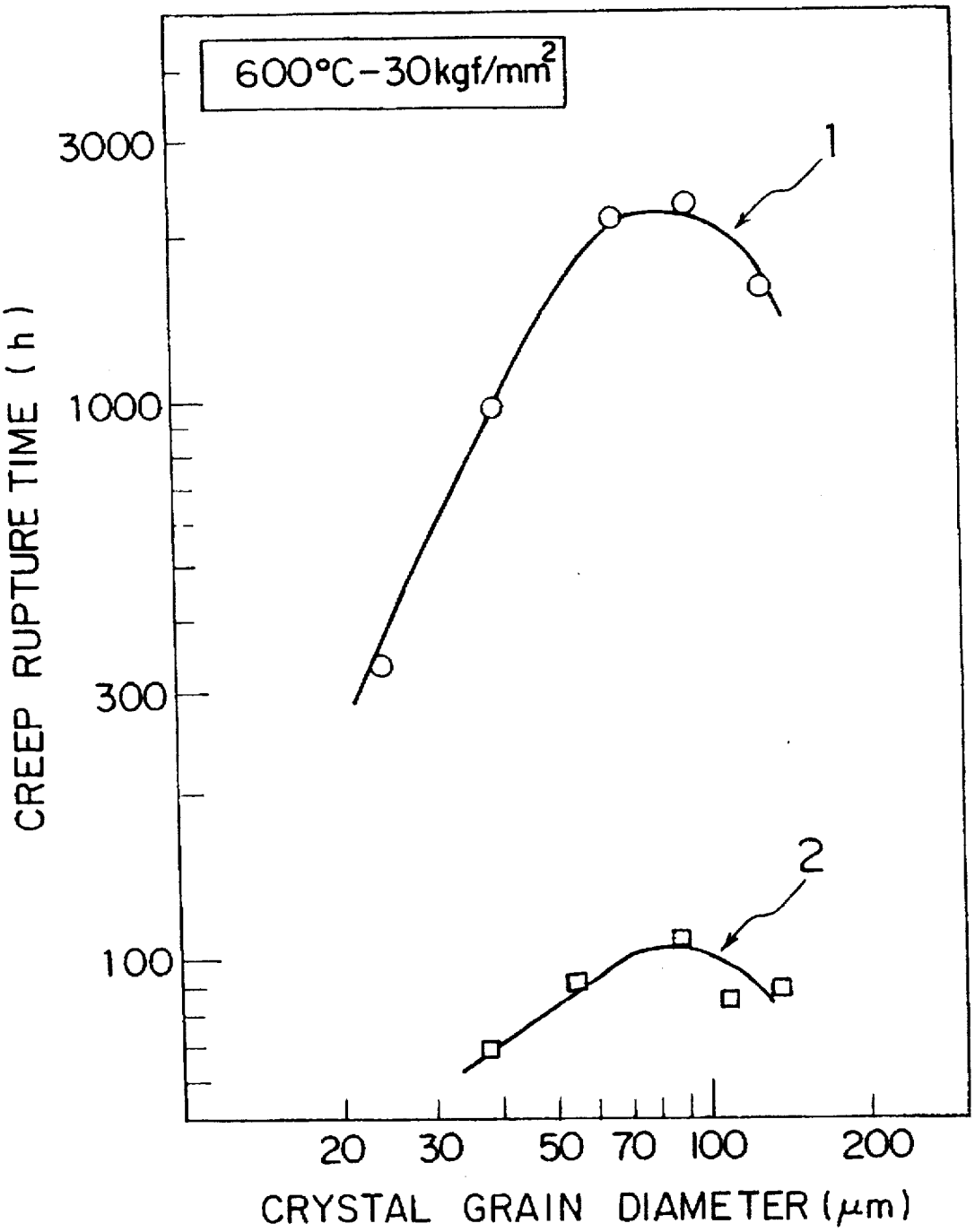
FIG. 1 is a diagram illustrative of the relationship between the creep rupture time and the average crystal grain diameter of the heat resistance steel of the present invention.
Figure 2:
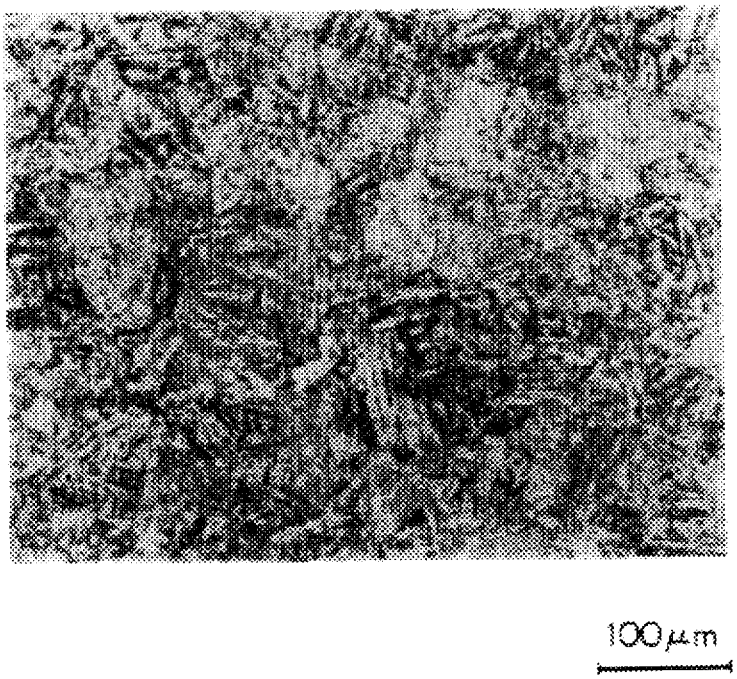
FIG. 2 is a microscopic photograph which shows a metal structure of the heat resistant still of the present invention.

The present invention will be described below with reference to the embodiments.

Embodiment 1

EXAMPLES 1 TO 10

Table 1 shows the chemical compositions of 14 kinds of heat resistant steel used as the test sample, and of them test samples No. 1 to 10 were made of the steels in the range of chemical compositions of the heat resistant steels of the present invention. These heat resistant steels were molten and cast in a vacuum high frequency induction furnace having an internal volume of 50 kg, followed by the appropriate rolling. The so rolled steels were quenched under the condition of oil-cooling them after the heating at 1120° C.×10 hours. Thereafter, they were subjected to the heat treatments under the tempering conditions of air-cooling them after the heating at 570° C.×10 hours and then air-cooing them after the heating at 690° C.×10 hours.

COMPARATIVE EXAMPLES 11 TO 14

The test samples No. 11 to 14 were outside the range of chemical compositions governing the heat resistant steels of the present invention. The test sample No. 11 was made of a steel disclosed in the Japanese Patent Publication No. 54385/1985; and the test sample No. 12 the Japanese Patent Publication No. 47488/1973. Both steels had been used as the rotor material for steam turbine under high and medium pressure. The test sample No. 13 was made of a steel having a Cr content lower than the range of chemical compositions of the present invention, and this steel had found its application as the rotor material for multi-purpose steam turbine to be operated under high and medium pressure. The test sample No. 14 was made of a steel having a content of various elements whose compositions are outside the range of the present invention. These test samples were prepared by treating the steel materials in the same way as in Examples 1 to 10.

TABLE 1

| Test | Chemical Compositions | | | | | | | | | | | | | | (The numerals mean wt. %) |
|---|---|---|---|---|---|---|---|---|---|---|---|---|---|---|---|
| Samples | C | Si | Mn | Ni | Cr | Mo | V | Nb | W | N | B | Re | Ta | Co | Fe |
| Present invention | | | | | | | | | | | | | | | |
| 1 | 0.13 | 0.05 | 0.50 | 0.40 | 11.00 | 0.11 | 0.21 | — | 2.58 | 0.040 | — | — | 0.23 | — | rest |
| 2 | 0.11 | 0.05 | 0.50 | 0.50 | 10.06 | 0.20 | 0.20 | — | 2.52 | 0.041 | 0.019 | 0.100 | 0.12 | — | rest |
| 3 | 0.12 | 0.04 | 0.50 | 0.48 | 10.02 | 0.22 | 0.20 | — | 2.51 | 0.042 | 0.009 | 0.152 | 0.06 | — | rest |
| 4 | 0.12 | 0.04 | 0.50 | 0.51 | 10.05 | 0.81 | 0.20 | 0.06 | 1.58 | 0.042 | — | 0.053 | — | — | rest |
| 5 | 0.11 | 0.05 | 0.50 | 0.50 | 9.98 | 0.11 | 0.19 | 0.15 | 2.69 | 0.040 | — | 0.051 | — | — | rest |
| 6 | 0.11 | 0.05 | 0.50 | 0.52 | 10.03 | 0.19 | 0.21 | 0.14 | 2.59 | 0.041 | — | 0.502 | — | — | rest |
| 7 | 0.11 | 0.05 | 0.50 | 0.51 | 10.02 | 0.52 | 0.19 | 0.20 | 2.08 | 0.040 | 0.017 | 0.048 | — | — | rest |
| 8 | 0.11 | 0.06 | 0.50 | 0.51 | 10.07 | 0.11 | 0.20 | 0.13 | 2.45 | 0.040 | 0.020 | 0.102 | 0.04 | — | rest |
| 9 | 0.11 | 0.05 | 0.49 | 0.50 | 10.45 | 0.11 | 0.19 | 0.14 | 2.48 | 0.036 | 0.019 | — | 0.06 | — | rest |

TABLE 1-continued

| Test | Chemical Compositions | | | | | | | | | | | | | | (The numerals mean wt. %) |
|---|---|---|---|---|---|---|---|---|---|---|---|---|---|---|---|
| Samples | C | Si | Mn | Ni | Cr | Mo | V | Nb | W | N | B | Re | Ta | Co | Fe |
| 10 | 0.11 | 0.05 | 0.50 | 0.72 | 9.03 | 0.10 | 0.20 | 0.10 | 1.55 | 0.045 | 0.020 | 1.205 | 0.15 | 2.88 | rest |
| Comparative Examples | | | | | | | | | | | | | | | |
| 11 | 0.14 | 0.03 | 0.59 | 0.69 | 10.10 | 0.99 | 0.18 | 0.05 | 1.00 | 0.042 | — | — | — | — | rest |
| 12 | 0.17 | 0.05 | 0.62 | 0.32 | 10.69 | 1.01 | 0.24 | — | — | 0.053 | — | — | 0.056 | — | rest |
| 13 | 0.30 | 0.06 | 0.68 | 0.35 | 1.12 | 1.03 | 0.26 | — | — | — | — | — | — | — | rest |
| 14 | 0.12 | 0.04 | 0.51 | 0.59 | 11.06 | 0.14 | 0.19 | 0.04 | 2.54 | 0.025 | 0.015 | — | — | — | rest |

A creep rupture test with 14 kinds of steel material described as above was conducted respectively under 5 conditions. On the basis of the results obtained from the test, the creep rupture strength at 580° C.—$10^5$ hours was determined by the use of the Larson-Miller parameter according to the interpolation method.

Furthermore, after a tempering heat treatment and a heat age hardening at 600° C. for 3000 hours were performed, notched test pieces for Charpy impact test according to JIS No. 4 having a thickness of 2 mm and V notch were prepared from the so age hardening steel materials, and a Charpy impact test with these test pieces was conducted, and the results thereof are shown in Table 2.

TABLE 2

| | | Properties | | |
|---|---|---|---|---|
| | | 580° C.-$10^5$ h Creep Rupture | Impact Value kgf-m/cm$^2$ | |
| Test Samples | | Strengh (kgf/mm$^2$) | Aft. Tempering heat treatment | Aft. Ageing at 600° C. × 3000 h |
| Present invention | 1 | 23.0 | 1.9 | 1.6 |
| | 2 | 23.0 | 1.7 | 1.6 |
| | 3 | 23.0 | 1.6 | 1.6 |
| | 4 | 23.5 | 1.5 | 1.5 |
| | 5 | 24.0 | 1.5 | 1.5 |
| | 6 | 25.0 | 1.7 | 1.5 |
| | 7 | 24.0 | 1.9 | 1.6 |
| | 8 | 24.5 | 1.9 | 1.8 |
| | 9 | 24.0 | 1.6 | 1.5 |
| | 10 | 24.5 | 1.7 | 1.6 |
| Comparative Examples | 11 | 16.0 | 4.1 | 1.8 |
| | 12 | 13.0 | 3.9 | 2.9 |
| | 13 | 8.0 | 1.7 | 1.4 |
| | 14 | 18.0 | 1.9 | 1.8 |

All the heat resistant steels of the present invention were found to have the creep rupture strength of 23.0 to 25.0 kgf/mm$^2$ at 580° C.—$10^5$ hours, far better than that of the comparative steels. Furthermore, the comparative steels had the highest impact value at 4.1 kgf-m/cm$^2$ after the tempering heat treatment, but it was found that their impact values were sharply reduced to 1.4 to 2.9 kgf-m/cm$^2$ after the ageing. On the other hand, the heat resistant steels of the present invention had the impact value of 1.5 to 1.9 kgf-m/cm$^2$ after the tempering heat treatment and again 1.5 to 1.8 kgf-m/cm$^2$ after the age hardening, and it was apparent that the impact values of the heat resistant steels of the present invention were not seriously affected by the age hardening.

To put it another way, the heat resistant steels in the range of chemical compositions of the present invention have a greatly improved creep rupture strength and are excellent in impact resistance after they are exposed to high temperatures for many hours as a rotor material for steam turbine, as compared with high-Cr ferrite steels conventionally used for the same purpose.

Embodiment 2

The total amount of precipitates will be described particularly in Embodiment 2.

The steel materials having the composition of Examples 2, 6 and 9 of Embodiment 1 were cast, rolled and then subjected to the heat treatments under the conditions of Nos. H1 to H4, to adjust the total amount of precipitates.

Thereafter the test samples made of these steels were subjected to the creep rupture under the condition of 630° C.—25 kgf/mm$^2$, and the so ruptured samples were determined for the total amount of their precipitates, and the results thereof are shown in Table 3. Meanwhile, H1 accounts for the heat treatments that were provided under the same conditions as in Embodiment 1.

Furthermore, the creep rupture strength of the test samples described as above was determined at 580° C.—$10^5$ hours, and the results thereof are shown in Table 3 as well.

TABLE 3

| Heat | Heat Treatment Conditions | | Test | Total Amount of Precipitates (wt. %) (1) | (2)* | | 580° C.-$10^5$ h Creep Rupture |
|---|---|---|---|---|---|---|---|
| Treatment No. | Quenching Conditions | Tempering Conditions | Sample No. | Aft. Tempering Heat Treatment | Aft. Creep Rupture | (2)-(1) | Strength (kgf/mm$^2$) |
| Present Invention | | | | | | | |
| H1 | 1120° C. × 10 h → oil cooling | 570° C. × 10 h → air cooling + | 2 | 4.42 | 5.68 | 1.26 | 23.0 |
| | | | 6 | 2.96 | 4.63 | 1.67 | 25.0 |

TABLE 3-continued

| Heat Treatment No. | Heat Treatment Conditions: Quenching Conditions | Heat Treatment Conditions: Tempering Conditions | Test Sample No. | Total Amount of Precipitates (wt. %) (1) Aft. Tempering Heat Treatment | (2)* Aft. Creep Rupture | (2)-(1) | 580° C.-$10^5$ h Creep Rupture Strength (kgf/mm$^2$) |
|---|---|---|---|---|---|---|---|
| | | 690° C. × 10 h → air cooling | 9 | 4.33 | 5.90 | 1.57 | 24.0 |
| H2 | | 570° C. × 10 h → air cooling + 650° C. × 10 h → air cooling | 2 | 5.53 | 5.59 | 0.06 | 24.0 |
| | | | 6 | 4.01 | 4.72 | 0.71 | 25.5 |
| | | | 9 | 4.93 | 5.88 | 0.95 | 25.0 |
| Comparative Examples | | | | | | | |
| H3 | | 770° C. × 5 h → air cooling | 2 | 2.32 | 5.60 | 3.28 | 18.0 |
| | | | 6 | 1.63 | 4.68 | 3.05 | 19.5 |
| | | | 9 | 1.98 | 5.75 | 3.77 | 18.0 |
| H4 | | 570° C. × 20 h → air cooling | 2 | 1.96 | 4.87 | 2.91 | 17.0 |
| | | | 6 | 1.42 | 4.42 | 3.00 | 18.5 |
| | | | 9 | 1.77 | 4.93 | 3.16 | 16.0 |

Note:
*630° C.-25 kgf/mm$^2$

The test samples were subjected to the heat treatments under the conditions of H1 and H2, to adjust the total amount of their precipitates to 2.96 to 5.53% by weight. Then, the test samples were creep-ruptured under the condition of 630° C.—25 kgf/mm$^2$, and it was found in all these test samples that the total amount of precipitates increased slightly and that the amount of increase [the value of (2)–(1) in Table 3] was at most 1.67% by weight.

On the other hand, the other test samples were subjected to the heat treatments under the conditions of H3 and H4, to adjust the total amount of their precipitates to 2.32% by weight or less. Then, the test samples were creep-ruptured and it was found that the total amount of precipitates increased by at least 2.91% by weight [the value of (2)–(1) in Table 3]. This increase was far greater than that of the heat treatments under the condition of H1 or H2, showing that these test samples comprised the metal structures having low stability during creeping.

Next, the relationship between the heat treatment condition and the creep rupture strength will be described. Heat-treated under the conditions of H1 and H2, all the rolled materials No. 2, No. 6 and No. 9 were found to have the creep rupture strength of at least 23.0 kgf/mm$^2$. Under the heat treatment conditions of H3 and H4, however, the creep rupture strength of these same materials was found to be at most 19.5 kgf/mm$^2$, far lower than in case of the heat treatments of H1 and H2.

In steels, therefore, the creep rupture strength can be improved to a great extent and the metal structures during creeping can be relieved of changes markedly by adjusting the total amount of their precipitates to a range of 2.5 to 7.0% by weight. To put it another way, Embodiment 2 has shown that even the steel materials in the range of compositions of the heat resistant steels of the present invention cannot meet the properties required for steam turbine, if the amount of their precipitates due to the the heat treatments are not in a predetermined range.

Embodiment 3

The method for heat treatment will be described particularly in Embodiment 3. The steel materials having the composition of Examples 2 and 7 and Comparative Example 11 of Embodiment 1 were molten and cast in a vacuum high frequency induction furnace having an internal volume of 50 kg. Thereafter, they were well rolled, subjected to the heat treatments under the 5 conditions as listed in Table 4. The heat treatments under the conditions of H1, H5 and H6 were within the scope of the present invention and those under the conditions of H7 and H8 were the comparative examples.

A creep rupture test was conducted respectively with the steel materials having 3 kinds of the compositions which were subjected to 5 kinds of the heat treatments. On the basis of the results thereof, the creep rupture strength at 580° C.—$10^5$ hours was determined by the use of tarson-Miller parameter according to the interpolation method. Furthermore, the ageing was performed at 600° C. for 3000 hours after the tempering heat treatments. A V-notched test piece for Charpy impact test JIS No. 2 having a thickness of 2 mm was prepared from the so aged steel materials, and a Charpy impact test with these test pieces was conducted, and the results thereof are shown in Table 5.

TABLE 4

| Heat Treatment No. | | Heat Treatment Conditions: Quenching Conditions | Heat Treatment Conditions: Tempering Conditions |
|---|---|---|---|
| Present Invention | H1 | 1120° C. × 10 h→ oil cooling | 570° C. × 10 h→air cooling + 690° C. × 10 h→air cooling |
| | H5 | 1100° C. × 10 h→ oil cooling | 570° C. × 10 h→air cooling + 690° C. × 10 h→air cooling |
| | H6 | 1100° C. × 10 h→ oil cooling | 570° C. × 10 h→air cooling + 720° C. × 10 h→air cooling |
| Comparative Examples | H7 | 1040° C. × 10 h→ oil cooling | 570° C. × 10 h→air cooling + 660° C. × 10 h→air cooling |
| | H8 | 1040° C. × 10 h→ oil cooling | 570° C. × 10 h→air cooling + 690° C. × 10 h→air cooling |

TABLE 5

| Heat Treatment No. | Properties: 580° C.-$10^5$h Creep Rupture Strength ($kgf/mm^2$) | | | Impact Values ($kgf-m/cm^2$) Aft. Tempering Heat Treatment Test Samples | | | Impact Values ($kgf-m/cm^2$) Aft. Ageing at 600° C. × 3000 h | | |
|---|---|---|---|---|---|---|---|---|---|
| | No. 2 | No. 7 | No. 11 | No. 2 | No. 7 | No. 11 | No. 2 | No. 7 | No. 11 |
| Present Invention | | | | | | | | | |
| H1 | 23.0 | 24.0 | 16.0 | 1.7 | 1.9 | 3.1 | 1.6 | 1.6 | 1.8 |
| H5 | 22.5 | 23.5 | 15.0 | 1.6 | 2.0 | 2.6 | 1.6 | 1.8 | 1.8 |
| H6 | 22.0 | 23.5 | 14.0 | 2.5 | 2.5 | 3.5 | 1.7 | 1.8 | 1.7 |
| Comparative Examples | | | | | | | | | |
| H7 | 19.5 | 16.0 | 14.0 | 4.1 | 3.6 | 4.6 | 1.5 | 1.6 | 1.6 |
| H8 | 20.0 | 13.0 | 12.0 | 3.9 | 4.7 | 5.8 | 1.7 | 1.8 | 1.9 |

The heat resistant steels of the present invention (Nos. 2 and 7 of Table 5) were subjected to the heat treatments within the scope of the present invention (the heat treatments under the conditions of H1, H5 and H6 of Table 5), with the result that all these steels had the creep rupture strength of 22.0 to 24.0 $kgf/mm^2$ at 580° C.—$10^5$ hours. This creep rupture strength was far better than in the case where the heat resistant steels of the present invention were subjected to the comparative heat treatments (the heat treatments under the conditions of H7 and H8 of Table 5). To put it another way, even the heat resistant steels of the present invention cannot obtain the appropriate creep rupture strength if they are subjected the heat treatments under the wrong conditions, particularly at the quenching temperatures of lower than 1050° C.

On the other hand, the comparative steel material (No. 11 of Table 5) was subjected to the heat treatments within the scope of the present invention and the comparative heat treatments, and it was found that the creep rupture strength was 12.0 to 16.0 $kgf/mm^2$ as the result of either heat treatment. In this way, the heat treatments within the scope of the present invention are very effective in obtaining the heat resistant steels of the present invention.

Next, the relationship between the heat treatment condition and the Charpy impact value will be described below.

The heat resistant steels of the present invention had the impact value of 1.6 to 2.5 $kgf-m/cm^2$ after the tempering heat treatment in all the cases where they were subjected to the heat treatments within the scope of the present invention. These impact values were lower than those obtained by subjecting the heat resistant steels of the present invention to the comparative heat treatments (2.6 to 3.5 $kgf-m/cm^2$). Furthermore, the comparative steels had high impact values at 2.6 to 5.8 $kgf-m/cm^2$ after the tempering heat treatment in all the cases where they were subjected to the heat treatments within the scope of the present invention and the comparative heat treatments. However, these high impact values were lowered up to 1.5 to 1.9 $kgf-m/cm^2$ after the steels were aged by heating them at 600° C. for 3000 hours, and it was found that the amount of decrease was markedly great in the impact values of the comparative steels subjected to the comparative heat treatments.

The heat treatments within the scope of the present invention provide the rotor materials for steam turbine with the greatly improved creep rupture strength and inhibit the decrease of impact values markedly after the heating for many hours, as compared with high-Cr ferrite steels conventionally used for the same purpose. Furthermore, these heat treatments within the scope of the present invention are very effective for the heat resistant steels in the range of chemical compositions of the present invention.

Embodiment 4

The crystal grain diameter will be described particularly in Embodiment 4 below. The steel materials of Example 3 and Comparative Example 13 of Embodiment 1 were molten and cast in a vacuum high frequency induction furnace having an internal volume of 50 kg. Thereafter, they were forged, rolled and quenched at various different temperatures, to adjust them to the metal structures having 5 different crystal grain diameters.

The creep rupture time of 10 different kinds of the steels having the different crystal grain diameters was determined at 600° C.—30 $kgf/mm^2$. Furthermore, a Charpy impact test at 20° C. was conducted by using the V-notched test pieces for Charpy impact test JIS No. 2 having the thickness of 2 mm and the results of these tests are shown in Table 6. Of these results, the relationship between the average crystal grain diameter and the creep rupture time is shown in FIG. 1.

TABLE 6

| Test Sample No. | Average Crystal Grain Diameter (μm) | 600° C.-30 $kgf/mm^2$ Creep Rupture Time (h) | Impact Value(20° C.) ($kgf-m/cm^2$) |
|---|---|---|---|
| 3 | 24 | 328 | 1.7 |
| | 39 | 982 | 1.8 |
| | 68 | 2160 | 1.6 |
| | 96 | 2301 | 1.4 |
| | 130 | 1604 | 1.0 |
| 13 | 37 | 68 | 1.4 |
| | 54 | 91 | 1.1 |
| | 88 | 108 | 1.0 |
| | 107 | 84 | 0.8 |
| | 136 | 88 | 0.9 |

In the Example 3 heat resistant steel in the range of chemical compositions of the present invention, the rupture time was found to increase along the straight line portion of a curve 1 representing the crystal grain diameters up to approximately 50 μm or less. The increase of the creep rupture time was slower with the crystal grain diameters of more than approximately 50 μm and was saturated with those of approximately 70 μm, and the creep rupture time was decreased with those of more than approximately 100 μm (Curve 1 of FIG. 1). On the other hand, in the Comparative Example 13 steels, the rupture time was found to increase slowly with the crystal grain diameters up to approximately 100 μm and the increase was saturated thereafter, along with the fall of the impact values (Curve 2 of FIG. 1).

The rotors for steam turbine made of the heat resistant steels excellent in the creep rupture time and the Charpy impact value can be obtained from the heat resistant steels in the range of chemical compositions of the present invention whose crystal grain diameters are adjusted to approximately 50 to 100 μm. Their advantages are far better than those of the high-Cr ferrite steels which have been used as the rotor material for steam turbine conventionally.

Embodiment 5

The electroslag remelting method will be described particularly in Embodiment 5 below. Four kinds of partial rotor model having a size of 1000 ϕ×800 mm were prepared from the steel materials having the composition of Example 8 of Embodiment 1. Of them, the models E1 to E3 were molten in an electric arc furnace and then cast into consumable electrode molds for use in electroslag remelting, followed by the electroslag remelting by the use of resultant cast iron ingots as the consumable electrode. The so processed materials were cast and forged to complete a rotor model material. The partial rotor model V1 was molten in an electric arc furnace, and then the cast iron ingots were prepared from the resultant melts by means of vacuum carbon deoxidation method and forged to complete a rotor model. These 4 kinds of rotor models were subjected to the heat treatments under the condition of H1, H5 or H9. Thereafter, with respect to the center portion and the surface layer portion of these 4 kinds of rotor models, a tensile test was conducted at room temperatures and a Charpy impact test was also conducted by using the V-notched test pieces for Charpy impact test JIS No. 4 having the thickness of 2 mm. The results thereof are shown in Table 7.

TABLE 7

| Rotor Model No. | Heat Treatment No. | Tested Part | Properties: 0.02% Tenacity (kgf/mm²) | Tensile Strength (kgf/mm²) | Elongation (%) | Reduction of Area (%) | Impact Value (20° C.) (kgf-m/cm²) | 580° C.-10⁵ h Creep Rupture Strength (kgf/mm²) |
|---|---|---|---|---|---|---|---|---|
| Present Invention | | | | | | | | |
| E1 | H1 | Surface layer | 71.3 | 95.2 | 20.9 | 66.7 | 1.9 | 24.5 |
| | | Center | 70.9 | 94.8 | 21.2 | 67.4 | 2.0 | 24.0 |
| E2 | H5 | Surface layer | 69.7 | 94.3 | 22.2 | 68.0 | 1.7 | 24.0 |
| | | Center | 69.6 | 94.0 | 22.0 | 67.6 | 1.8 | 23.5 |
| E3 | H9* | Surface layer | 71.1 | 94.5 | 21.8 | 67.1 | 1.7 | 24.0 |
| | | Center | 70.3 | 94.2 | 21.4 | 65.5 | 1.6 | 24.0 |
| Comparative Examples | H5 | Surface layer | 69.8 | 94.5 | 22.6 | 67.8 | 1.6 | 23.5 |
| V1 | | Center | 60.1 | 84.3 | 23.5 | 69.7 | 1.3 | 16.5 |

Note:
*Heat Treatment Condition of H9
Quenching Conditions: 1070° C. × 10 h → oil cooling
Tempering Conditions: 570° C. × 10 h → air cooling + 680° C. × 10 h → air cooling The rotor models E1 to E3 prepared by using the electroslag remelting method and the rotor model V1 prepared according to the vacuum carbon deoxidation method were found to have the almost equal tensile properties and Charpy impact value. However, the center portion of the rotor model V1 of the vacuum carbon deoxidation method were found to have the tensile properties and Charpy impact value which are far lower than those of the rotor models E1 to E3 prepared according to the electroslag remelting method.

Next, the creep rupture test was conducted with respect to the center portion and the surface layer portion of 4 kinds of rotor models described as above. On the basis of the results thereof, the creep rupture strength at 580° C.—$10^5$ hours was determined by the use of the Larson-Miller parameter according to the interpolation method. The results thereof are shown in Table 7. All of rotor model E1 to E3 prepared according to the electroslag remelting method were found to have far greater creep rupture strength than that of rotor model V1 prepared by the vacuum carbon deoxidation method. Furthermore, it was found that the creep rupture strength of the center portion was equal to that of the surface layer portion in rotor models E1 to E3. The rotor model V1 prepared by the vacuum carbon deoxidation method had the values almost equal to those of the electroslag remelting method material in the surface layer portion but the markedly low creep rupture strength in the center portion.

Large size steel ingots having a homogeneous structure and rotors for steam engine keeping these superior and homogeneous characteristics unchanged can be obtained by applying the electroslag remelting method to the heat resistant steels in the range of chemical compositions of the present invention.

As described in the embodiments above, the rotors for steam engine of the present invention are made of the heat resistant steels having the martensite structure in the range of chemical compositions of the present invention. They have the greatly improved creep rupture strength, capable of meeting the design stress appropriately, as compared with high-Cr ferrite steels which have been conventionally used in the rotors for steam turbine. Furthermore they are superior in impact resistance when they are exposed to high temperatures for a long term.

The heat resistant steels of the present invention are subjected to the heat treatments at a quenching temperature of 1050° to 1150° C. and, after the quenching, the additional heat treatments at a temperature of 620° to 760° C., to adjust in a manner that the precipitates are deposited into the crystal grain boundaries and martensite lath boundaries and in the inside of martensite lath in a total amount of 2.5 to 7% by weight and that the austenite crystals have an average grain diameter of 50 to 100 μm. In this way, the heat resistant steels of the present invention have a metal structure which is homogeneous and remain highly stable after it is exposed to high temperatures for a long term. Accordingly, the heat resistant steels of the present invention have the greatly improved high-temperature creep rupture strength and creep resistance, relieved of too much decline of the characteristics after the exposure to high temperatures for a long term.

The steel ingots to form the heat resistant steels of the present invention are prepared by the electroslag remelting method. Accordingly, large size steel ingots having a homogeneous structure are obtained, keeping the superior and homogeneous characteristics described as above remain unchanged.

Accordingly, the rotors for steam turbine of the present invention can operate with high reliability for a long term, exposed to the severe steam conditions wherein high temperature and high pressure are predominant, to contribute much to the improvement of the performance and workability of steam turbines and provide the advantages useful to industry.

What is claimed is:

1. A rotor for a steam turbine made of a heat resistant steel having a composition consisting of 0.05 to 0.30% by weight of C, 8.0 to 13.0% by weight of Cr, more than 0 to 1.0% by weight of Si, more than 0 to 1.0% by weight of Mn, more than 0 to 2.0% by weight of Ni, 0.10 to 0.50% by weight of V, 0.50 to 5.0% by weight of W, 0.025 to 0.10% by weight of N, more than 0 to 1.5% by weight of Mo, at least one element selected from the group consisting of 0.03 to 0.25% by weight of Nb and 0.03 to 0.50% by weight of Ta, more than 0 to 3% by weight of Re, 0 to 5.0% by weight of Co, 0 to 0.05% by weight of B and the balance Fe and inevitable impurities, and having a martensite structure.

2. The rotor according to claim 1, wherein said at least one element selected from the group consisting of 0.03 to 0.25% by weight of Nb and 0.03 to 0.50% by weight of Ta is 0.03 to 0.50% by weight of Ta.

3. The rotor according to claim 1, wherein said at least one element selected from the group consisting of 0.03 to 0.25% by weight of Nb and 0.03 to 0.50% by weight of Ta is 0.03 to 0.25% by weight of Nb.

4. The rotor according to claim 1, wherein said at least one element selected from the group consisting of 0.03 to 0.25% by weight of Nb and 0.03 to 0.50% by weight of Ta is 0.03 to 0.50% by weight of Ta and 0.03 to 0.25% by weight of Nb.

5. The rotor according to claim 1, wherein said Co is in an amount of 0.001 to 5.0% by weight.

6. The rotor according to claim 1, wherein said B is in an amount of 0.0005 to 0.05% by weight.

7. The rotor according to claim 1, wherein said heat resistant steel is quenched at a temperature in a range of 1050° to 1150° C.

8. The rotor according to claim 7, wherein said heat resistant steel is subjected to the heat treatment at a temperature in a range of 620° to 760° C. at the lowest after quenching.

9. The rotor according to claim 8, wherein said heat resistant steel has precipitates in a total amount of 2.5 to 7.0% by weight due to said heat treatment.

10. The rotor according to claim 8, wherein said heat resistant steel comprises austenite crystals having a grain diameter of 50 to 100 μm after said heat treatment.

11. The rotor according to claim 1, wherein said heat resistant steel having said composition is molten according to the electroslag remelting method.

12. A method for manufacturing a heat resistant steel for a steam turbine rotor, comprising the steps of:

preparing a steel alloy having a composition consisting of 0.05 to 0.30% by weight of C, 8.0 to 13.0% by weight of Cr, more than 0 to 1.0% by weight of Si, more than 0 to 1.0% by weight of Mn, more than 0 to 2.0% by weight of Ni, 0.10 to 0.50% by weight of V, 0.50 to 5.0% by weight of W, 0.025 to 0.10% by weight of N, more than 0 to 1.5% by weight of Mo, at least one element selected from the group consisting of 0.03 to 0.25% by weight of Nb and 0.03 to 0.50% by weight of Ta, more than 0 to 3% by weight of Re, 0 to 5.0% by weight of Co, 0 to 0.05% by weight of B and the balance Fe and inevitable impurities, melting said steel alloy in an electric arc furnace to prepare a primary steel ingot;

remelting and casting said primary steel ingot by an electroslag remelting method to prepare a secondary steel ingot;

forging said secondary steel ingot to form a forged steel product in the form of a rotor;

heating said forged steel product at a temperature in a range of 1050° to 1150° C.;

quenching said heated steel product; and heat-treating said quenched steel product at a temperature in a range of 620° to 760° C. in a manner that the total amount of precipitates is in a range of 2.5 to 7.0% by weight.

* * * * *